US005595383A

United States Patent [19]

Hochhausl

[11] Patent Number: 5,595,383

[45] Date of Patent: Jan. 21, 1997

[54] TRANSPORT UNIT FOR A STACK OF LETTERS HAVING A STATIONARY HELICAL SLIDE

[75] Inventor: Markus Hochhausl, Konstanz, Germany

[73] Assignee: Licentia Patent-Verwaltungs-GmbH, Frankfurt am Main, Germany

[21] Appl. No.: 361,725

[22] Filed: Dec. 23, 1994

[30] Foreign Application Priority Data

Jan. 4, 1994 [DE] Germany ..... 44 00 086.3

[51] Int. Cl.[6] ..... B65H 1/02; B65H 1/00

[52] U.S. Cl. ..... 271/149; 271/163; 271/213; 198/724

[58] Field of Search ..... 271/3.01, 3.12, 271/145, 149, 207, 162–163, 213–215; 198/724

[56] References Cited

U.S. PATENT DOCUMENTS

| | | | |
|---|---|---|---|
| 3,306,432 | 2/1967 | Hoagland . | |
| 3,329,254 | 7/1967 | De Pass | 271/145 X |
| 3,726,391 | 4/1973 | Napp | 198/724 |
| 3,869,115 | 3/1975 | Barkley | 271/213 X |
| 4,756,403 | 7/1988 | Sasaki et al. | 198/724 |
| 5,291,987 | 3/1994 | Zink | 198/724 |

FOREIGN PATENT DOCUMENTS

| | | | |
|---|---|---|---|
| 95573 | 12/1983 | European Pat. Off. | 271/207 |

*Primary Examiner*—Boris Milef
*Attorney, Agent, or Firm*—Spencer & Frank

[57] ABSTRACT

A transport unit having a shaft for receiving a stack of letters includes a stationary helical slide forming a bottom of the shaft and having an approximately vertical axis. The helical slide has an upper and a lower end each defining a transfer point for selectively feeding in and feeding out the stack of letters. A conveying device is provided operatively acting with the shaft for displacing the stack of letters on the helical slide.

5 Claims, 4 Drawing Sheets

TRANSPORT UNIT FOR A STACK OF LETTERS HAVING A STATIONARY HELICAL SLIDE

BACKGROUND OF THE INVENTION

The invention relates to a transport unit having a shaft for receiving a stack of letters.

In mail-sorting facilities, items are often sorted multiple times. In such cases, a long, linear transport belt is provided which supports a correspondingly long stack of letters. This type of arrangement requires a large amount of space. Moreover, long stacks of letters tend to become compressed and bulge out. Numerous steps are required for feeding, reloading and unloading the letters.

Transport containers which carry boxes that receive a plurality of letters are known for transporting stacks of letters.

SUMMARY OF THE INVENTION

The object of the invention is to provide a transport unit that has a space-saving design and that facilitates the processing of a stack of letters.

According to the invention, the above object is accomplished by a stationary helical slide forming a bottom of the shaft and having an approximately vertical axis. The helical slide has an upper and a lower end each defining a transfer point for selectively feeding in and feeding out the stack of letters. A conveying device is provided operatively acting with the shaft for displacing the stack of letters on the helical slide.

The transport unit according to the invention has a compact design. The transport unit can be easily transported.

The transport unit can simplify the processing of a stack of letters in numerous applications. For example, the transport unit can be used in mail-distribution facilities to transport postal items. It can also be used as a feeder for a material inserter in a letter separator. Furthermore, the transport unit is suited for unloading from sorting compartments, for intermediate storage of stacked mail, or as an intermediate buffer in which the postal items are simultaneously fed in at the lower transfer point and fed out at the upper transfer point.

The helical shape of the slide prevents the stack of letters from compressing and bulging out.

So that the letters align themselves on their front edge, in an embodiment of the invention, the slide is inclined in the radial direction with respect to the helical axis. The front edges of the letters are thus supported against a side wall of the slide. The slide is preferably inclined toward the outside.

The conveying apparatus preferably comprises a sliding plate that can move along the slide using a drive, and that extends into the shaft. However, other forms of the converging apparatus can also be used. For example, curved chains or conveyor belts extending parallel to the slide can be provided. Compressed air conveyance or vibration conveyance is also possible. A rotatable conveying helix can also be provided.

BRIEF DESCRIPTION OF THE DRAWINGS

Further advantageous embodiments of the invention ensue from the dependent claims and the following description. The drawings show in:

DETAILED DESCRIPTION OF THE INVENTION

Figure 1:
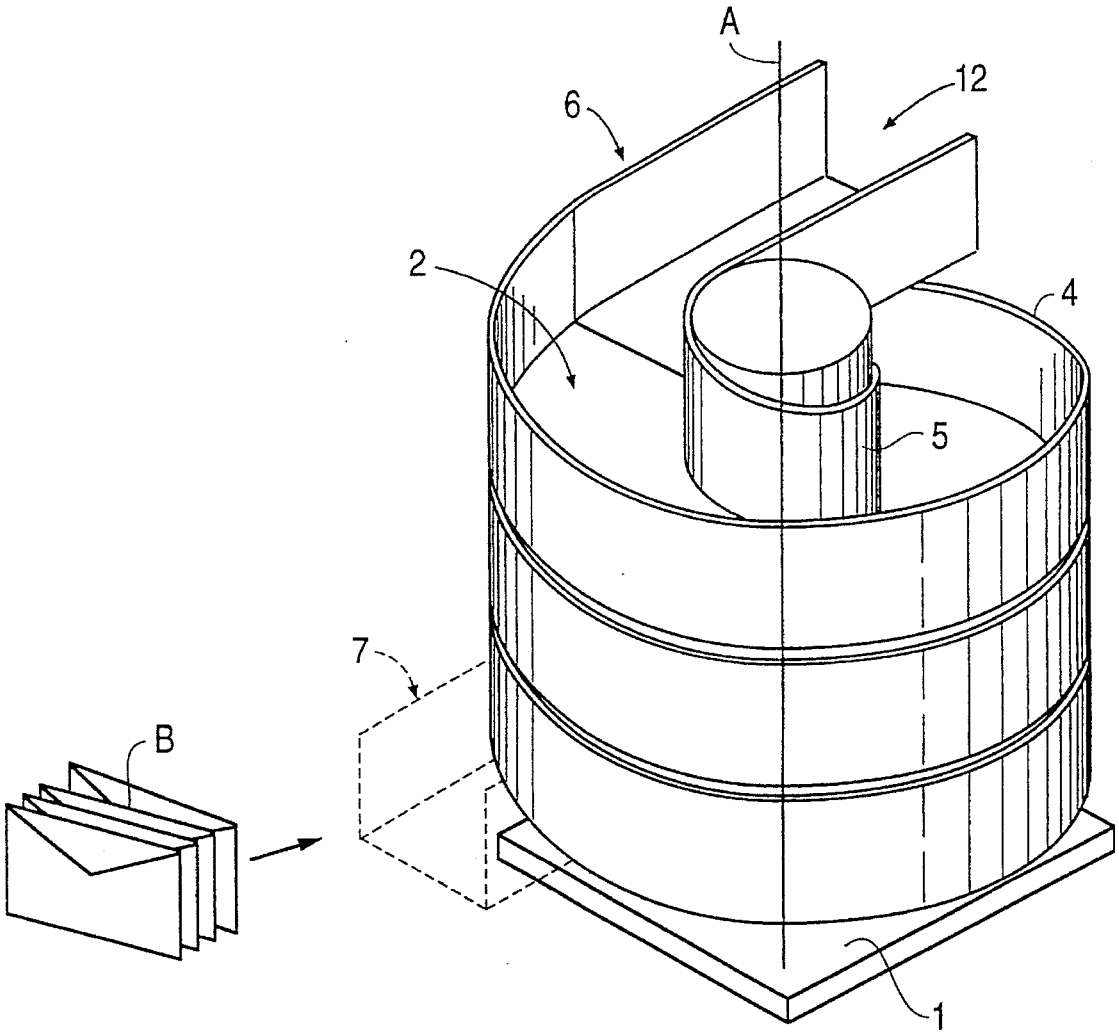
FIG. 1 a transport unit in a schematic, perspective view.
Figure 2:
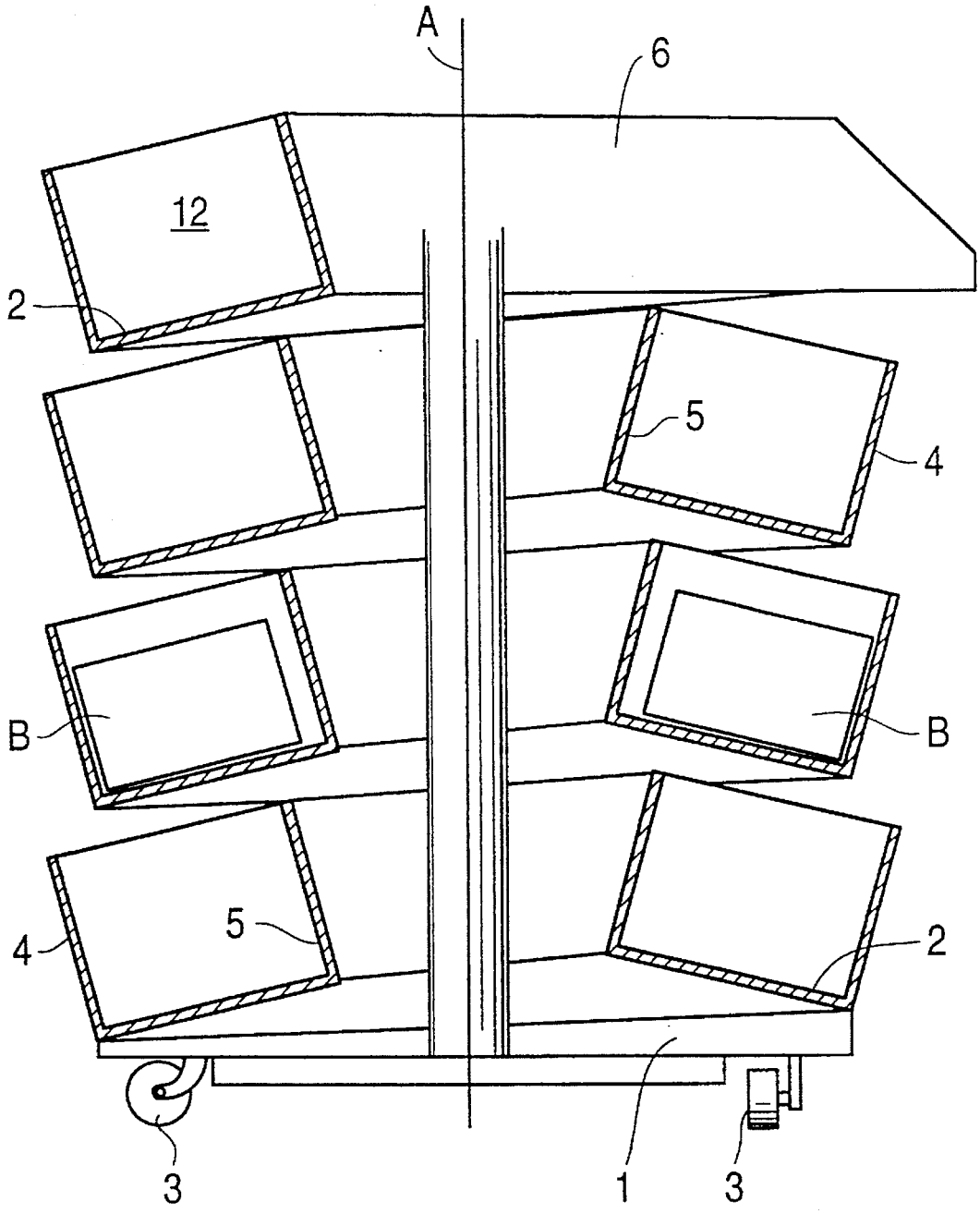
FIG. 2 a transport unit in schematic, longitudinal sectional view.

Referring to FIGS. 1 and 2, a slide (2) is secured to a carrier (1). The carrier (1) is provided with, for example, casters (3).

A shaft 12 receives a stack of letters B, and has as a bottom, slide 2. The slide (2) extends in a helical shape, with a plurality of curves encircling a vertical helical axis (A). The shaft 12 is defined laterally by an outside wall (4) and an inside wall (5).

A transfer point (6) is joined at the upper end of the slide (2). A transfer point (7) is formed at the lower end of the slide (2). The transfer points (6, 7) can selectively serve to feed-in or feed-out the letters. The transfer parts (6,7) extend approximately horizontally and tangentially to the helical shape of the slide (2).

In the embodiment according to FIG. 2, the slide (2) is outwardly inclined in the radial direction with respect to the helical axis (A). Correspondingly, the outside wall (4) and the inside wall (5) stand at a diagonal. Because of this inclination, letters (B) slide i.e. to the outside, to the outside wall (4), on slide (2), which aligns their front edges.

A number of postal items, for example 3000 letters, may be accommodated in a space-saving manner in the transport unit. The transport unit can be easily transported, for example rolled from one station to another in a mail-sorting or distribution facility, or conveyed in a mail car.

Figure 3:
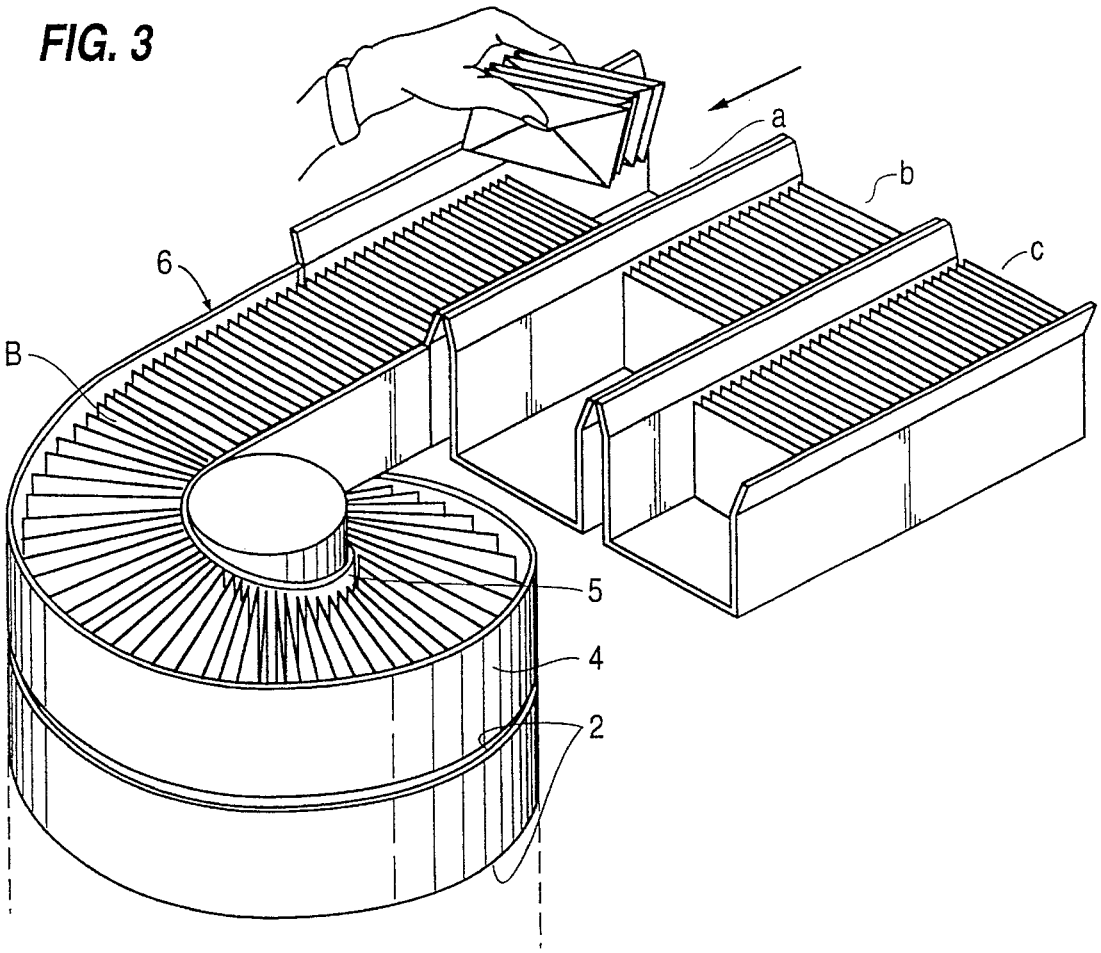
FIG. 3 an example of the transport unit in use.

In FIG. 3 the transport unit is shown set up with sorting compartments (a, b, c). Letters are pushed manually, one after the other, out of the respective compartments (a, b, c) and onto slide (2) via the upper transfer point (6). Once a sorting compartment is emptied, the transport unit is rolled to the next sorting compartment, whose letters can then likewise be pushed onto the slide (2). In this stage, the lower transfer point (7) is typically closed.

Figures 4, 5:
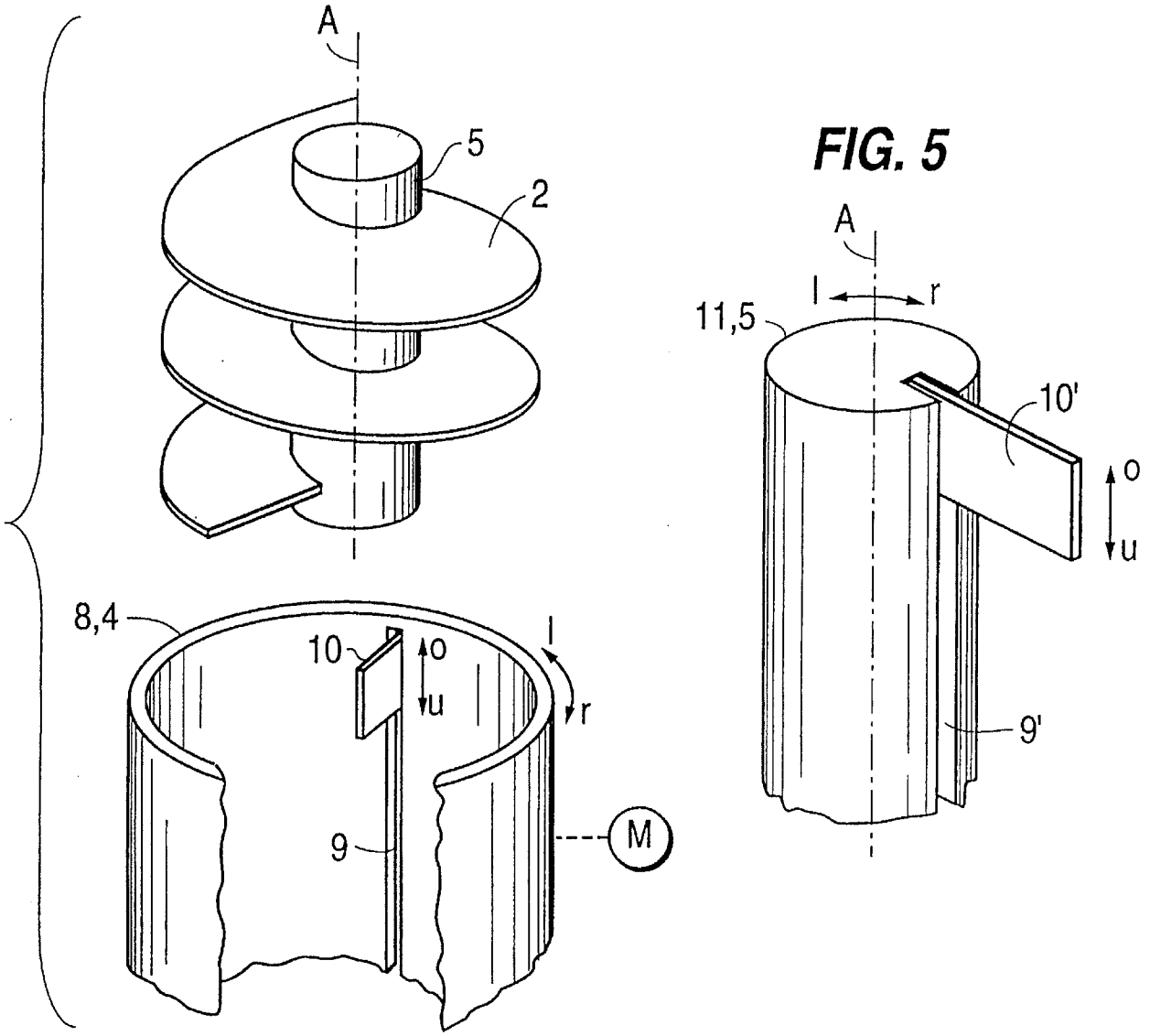
FIG. 4 schematic view of a conveying apparatus of the transport unit.
FIG. 5 an alternative embodiment to FIG. 4.

So that the letters can be moved mechanically on the slide (2), the transport unit includes a conveying apparatus (see FIG. 4 and FIG. 5). FIG. 4 shows the slide (2) and the conveying apparatus separated from one another with in the axial direction.

The conveying apparatus according to FIG. 4 has a sleeve (8), which forms the outside wall (4) of the shaft 12. The sleeve (8) is coaxial to the helical axis (A), and can rotate about the helical axis (A) on carrier (1) using a motor M not shown in detail. The sleeve (8) has a slot (9) which extends approximately vertically over the height of the slide (2), and in which a sliding plate (10) is seated to be displaceable in height. The sliding plate (10) projects radially over the slide (2) and into the shaft slide (2) forms, which receives the stack of letters.

If the sleeve (8) rotates in the direction of the arrow (r or l), the sliding plate (10) is then correspondingly carried along. Simultaneously, sliding plate (10) slides upwardly on the slide (2) in the direction of the arrow (o), or downwardly in the direction of the arrow (u). Depending on the direction of rotation, the sliding plate (10) pushes the stack of letters lying on the stationary slide (2) either upwardly toward the transfer point (6), or downwardly toward the transfer point (7). An unloading or loading of the shaft of the transport unit is thus possible.

In the conveying apparatus according to FIG. 5, a cylindrical inside part (11), which is coaxial to the helical axis (A) and forms the inside wall (5), is provided. The inside part (11) is seated on the carrier (1), and can rotate in the direction (r) or direction (1), relative to the stationary slide (2), using a motor not shown in detail. In this case, the outside wall (4) is fixed against relative rotation with respect to the stationary slide (2). The slot (9') in which the sliding plate (10') is vertically displaceable is found on the inside part (11). During the rotation of the inside part (11), the stack of letters is conveyed, as described, upwardly or downwardly by the sliding plate (10).

I claim:

1. A transport unit having a shaft for receiving a stack of letters, comprising:

a stationary helical slide forming a bottom of the shaft and being wound around an approximately vertical axis, said helical slide having an upper end and a lower end, each end defining a transfer point for selectively feeding in and feeding out the stack of letters;

a sleeve surrounding said helical slide and being coaxial to and rotatable about the vertical axis;

drive means operatively connected to said sleeve for rotating said sleeve; and conveying means operatively acting with the shaft for displacing the stack of letters on said helical slide, said conveying means comprising a sliding plate positioned on said sleeve to extend into the shaft so as to come into engagement with the stack of letters.

2. A transport unit as defined in claim 1, wherein said sliding plate is vertically displaceable on said sleeve.

3. A transport unit as defined in claim 1, wherein said sleeve forms an outside wall of said shaft.

4. A transport unit as defined in claim 1, further comprising a traveling carrier having said helical slide secured thereto.

5. A transport unit as defined in claim 1, wherein the transfer points are tangential to said helical slide and located in an approximately horizontal plane.

* * * * *